US012747653B2

(12) United States Patent
Pattison et al.

(10) Patent No.: US 12,747,653 B2
(45) Date of Patent: Sep. 29, 2026

(54) CONNECTOR ASSEMBLY FOR EMERGENCY DECOUPLING OF A SUBSEA END FITTING OF A MOVABLE SUBSEA STRUCTURE

(71) Applicant: S3N Ventus Ltd, Ashington (GB)

(72) Inventors: Richard Pattison, Ashington (GB); Michael Stanton, Ashington (GB); Paul Groves, Ashington (GB)

(73) Assignee: S3N Ventus Ltd (GB)

( * ) Notice: Subject to any disclaimer, the term of this patent is extended or adjusted under 35 U.S.C. 154(b) by 0 days.

(21) Appl. No.: 19/135,706

(22) PCT Filed: Dec. 8, 2023

(86) PCT No.: PCT/GB2023/053179
§ 371 (c)(1),
(2) Date: Jun. 4, 2025

(87) PCT Pub. No.: WO2024/121575
PCT Pub. Date: Jun. 13, 2024

(65) Prior Publication Data

US 2026/0201777 A1 Jul. 16, 2026

(30) Foreign Application Priority Data

Dec. 9, 2022 (GB) ..... 2218538.3

(51) Int. Cl.
*E21B 43/01* (2006.01)
*E21B 17/01* (2006.01)
(Continued)

(52) U.S. Cl.
CPC ..... *E21B 43/0107* (2013.01); *E21B 17/017* (2013.01); *E21B 17/0465* (2020.05); *E21B 19/004* (2013.01); *E21B 23/02* (2013.01)

(58) Field of Classification Search
CPC .. E21B 43/107; E21B 17/0465; E21B 17/017; E21B 19/004; E21B 23/02
See application file for complete search history.

(56) References Cited

U.S. PATENT DOCUMENTS 5,947,642 A * 9/1999 Teixeira ..... F16L 37/096 405/195.1
6,536,527 B2 * 3/2003 Munk ..... E21B 43/0107 166/341
(Continued)

FOREIGN PATENT DOCUMENTS

AU 2012306426 A1 3/2014
EP 3241976 A1 11/2017
(Continued)

OTHER PUBLICATIONS

International Search Report and Written Opinion of PCT/GB2023/053179, Issued Feb. 12, 2024.
Diverless Bend et a.: "Flexible Engineered Solutions International" Jan. 15, 2015.

*Primary Examiner* — D. Andrews
(74) *Attorney, Agent, or Firm* — The Belles Group, P.C.

(57) ABSTRACT

A connector assembly for decoupling of an end fitting of a movable subsea structure from a fixed subsea structure. The connector includes a first body having a first end configured for receipt into the tubular subsea structure, a second end formed into a receiving socket portion and one or more recesses in an inner wall of the socket portion; a second body having a first end configured for receipt into the socket portion of the first body and a second end configured for connection to one end of the movable subsea structure; the connector assembly includes a plurality of first coupling members mounted in the second body and movable between an extended position and a retracted position; a locking member mounted in the second body and movable between an engaged position and a disengaged position; and a
(Continued)

frangible retaining member configured to retain the locking member in the engaged position.

21 Claims, 11 Drawing Sheets

(51) Int. Cl.

| | |
|---|---|
| ***E21B 17/046*** | (2006.01) |
| ***E21B 19/00*** | (2006.01) |
| ***E21B 23/02*** | (2006.01) |

(56) References Cited

U.S. PATENT DOCUMENTS

| | | | | |
|---|---|---|---|---|
| 8,016,520 | B2 * | 9/2011 | Dybvik | B63B 27/24 166/359 |
| 10,144,488 | B2 * | 12/2018 | Shield | B63B 21/20 |
| 2011/0094748 | A1 | 4/2011 | Reddy | |
| 2021/0348449 | A1 | 11/2021 | Pinho Dos Reis et al. | |

FOREIGN PATENT DOCUMENTS

| | | | |
|---|---|---|---|
| EP | 2932013 | B1 | 3/2018 |
| EP | 3473801 | A1 | 4/2019 |
| WO | 1998/23845 | A1 | 6/1998 |
| WO | 2016038396 | A1 | 3/2016 |

* cited by examiner

CONNECTOR ASSEMBLY FOR EMERGENCY DECOUPLING OF A SUBSEA END FITTING OF A MOVABLE SUBSEA STRUCTURE

TECHNICAL FIELD OF INVENTION

The present invention relates generally to the field of subsea tubulars and manifolds, and more particularly, to the field of subsea tubular connections of flexible umbilicals to a fixed structure including devices for limiting the bend of the flexible tubulars or umbilicals. In particular, the present invention relates to an improved connector assembly for emergency decoupling of an end fitting of a movable subsea structure (e.g. a subsea tubular) from a tubular fixed subsea structure (e.g. an I- or J-tube), which is adapted for intervention-less installation of marine equipment such as, for example, a bend-stiffener for cables connecting to Floating Offshore Wind (FOW) facilities, and which permits disconnection in the event of excessive tension in the subsea tubular.

BACKGROUND

In subsea operations, it is often required to use a string of tubulars, also called a 'riser', to connect equipment on the seafloor with a fixed structure above, such as, for example, an offshore floating platform or a vessel. The string of tubulars or riser usually includes conduits or a plurality of conduits used for safe transport of material (e.g. hydrocarbon production fluid, such as, crude oil or gases). The string of tubulars or risers may include cabling or control lines so as to allow remote control of any equipment from the surface structure (i.e. the platform or vessel).

FIG. 1 shows an example of a typical setup for subsea operation, where production fluid is transferred from at least one subsea well 10 to a floating production, storage and offloading unit 20, also referred to as FPSO 20. Also, Wind turbines 95 of an FOW (floating offshore wind) may be connected via subsea cables 97. A flexible riser 30 (string of tubulars) is used to transports the production fluid from the well 10, or a seabed production field in case of multiple wells, to the FPSO 20 via turret 40 installed on the FPSO 20. In order to protect the flexible riser 30 from excessive cyclic bending, for example, due to movement that may be caused by waves, current or wind, or which may simply be caused by the movement of the FPSO 20, one or more bend stiffeners 50 (only one connection is shown in FIG. 1) are typically used at the junction where the flexible riser 30 enters the fixed structure (i.e. through an 'I'- or 'J' tube 60).

Often, the bend stiffener 50 is installed to the 'I'- or 'J'-tube 60 via a releasable connector assembly 70. The releasable connector assembly 70 may comprises a male connector member 72 that is fitted to the bend stiffener 50, and a female connector member 74 that is fitted to the 'I'- or 'J'-tube 60. During installation, the male connector member 72 is attached to the bend stiffener 50 and an end-fitting 32 of the riser 30 is located within and attached to the male connector member 72. In particular, the end-fitting 32 of the riser 30 is moved through the bend stiffener 50 into the throughbore of the male connector member 72 and locked into place by, for example, a cam device, a simple clamp mechanism 78, a latch mechanism or any other suitable interlocking mechanisms (not shown). The end-fitting 32 of the string of tubulars 30 is typically installed to the male connector member 72 in a workshop.

The assembly (i.e. riser 30, end-fitting 32, bend stiffener 50 and male connector member 72) is then transported to a desired subsea location and pulled towards and into connection with the female connector member 74 using a wire line 80 that is attached to the end-fitting 32 of the riser 30. Once the male connector member 72 is correctly positioned within the female connector member 74, it is retainingly interlocked with the female connector member 74, forming a secure connection between the bend stiffener 50 and the 'I' or 'J' tube 60. After locking the male connector member 72 inside the female connector member 74, the end-fitting 32 is released from engagement with the male connector portion 72 and the riser 30 is drawn up and through the bend stiffener 50 and the 'I'- or 'J'-tube to be fixed into place at the FPSO 20.

Often, the locking and unlocking of the male and female connector members 72, 74, as well as the release of the riser end-fitting 32 from engagement with the male connector member 72, is done through external intervention, such as, for example, subsea divers 90 or Remotely Operated Vehicles (ROV's) 92. In order to at least minimise the time and/or costs, as well as potential risks when using subsea divers 90 or ROV's 92, currently available connector assemblies have been since been improved to also use remotely operable latch-mechanisms and/or end-fitting release mechanisms.

The releasable coupling between the male connector member and the female connector member is typically realised using pivoting latch arms (see latch arm 76 in FIG. 1) that are mounted to the female connector member and which are configured to contactingly engage with a lip or shoulder portion of the male connector member, so that the male connector member is 'hanging' from the radially inwardly projecting latch arms.

However, for this type of coupling engagement, any relative movement between the male connector member and the female connector member can impose substantial stress onto the latch arms, as well as, the engaging lip or shoulder portion of the male connector member. In particular, any axial dislocation between the male connector member and the female connector member, when engaged, may 'rock' the lip or shoulder portion up and down when sitting on respective latch arms, thus, repeatedly hammering the latch arms up to the point of potential failure. Further, currently available latch mechanisms may allow for small relative movement between the male connector member and the female connector member (e.g. caused by movement of the floating structure, wave or wind movement transmitted to the string of tubulars, or even the pressurised fluid pumped through the conduit(s)), but at the cost of an increased risk of damage due to fatigue and wear from recurring high pressures, shear stresses, imbalanced engagement and/or continuous movement between contacting surfaces between the male and female connector member.

The subsea tubular is subject to continuous changes in applied load. It is therefore desirable for the end fitting and the I- or J-tube to be disconnected automatically on application of an excessive load, in order to prevent damage. However, it is also desirable for such automatic disconnection to be able to withstand an increased load, greater than a nominally excessive level, which is only applied momentarily, to ensure that disconnection only occurs when an excessive load is applied for a period of time sufficient for damage to occur otherwise.

SUMMARY OF THE INVENTION

In accordance with the present invention, a connector assembly for emergency decoupling of an end fitting of a movable subsea structure from a tubular fixed subsea structure, comprises:

- a first tubular body comprising a first end configured for receipt into, and releasable retention in, the fixed tubular subsea structure, a second end formed into a receiving socket portion and one or more recesses in an inner wall of the socket portion;
- a second tubular body having a first end configured for receipt into the socket portion of the first tubular body and a second end configured for connection to one end of the movable subsea structure;

the connector assembly further comprising:

- a plurality of first coupling members mounted in the second tubular body and movable between an extended position in which they are received in the one or more recesses in the inner wall of the socket portion and a retracted position in which they are withdrawn from the one or more recesses;
- a locking member mounted in the second tubular body and movable between a first, engaged position in which it retains the first coupling members in their extended position and a second, disengaged position in which it allows the first coupling members to move towards their retracted position; and
- a frangible retaining member configured to retain the locking member in the first, engaged position.

Subsea tubulars are subject to continuous changes in applied load. When excessive tension is applied to a subsea tubular, the hang-off connection between an end fitting of the subsea tubular and the I- or J-tube to which it is attached would normally be configured to release and as a consequence, the end fitting and the tubular fall downwardly. In such circumstances, the connector assembly of the present invention is contacted by the end fitting. If the load applied to the subsea tubular exceeds the load at which the frangible retaining member is designed to fail, the locking member is no longer retained in its first, engaged position which allows the first coupling members to be released from their extended, engaged position. As a consequence, the second tubular body of the connector assembly disconnects from the first tubular body, resulting in the emergency release of the subsea tubular and its end fitting.

Each first coupling member is preferably mounted in an aperture passing through a wall of the second tubular body and extends beyond an outer surface of the second tubular body when in the extended position.

The inner wall of the socket portion of the first tubular body preferably comprises an annular recess in which the first coupling members are received when in their extended position.

The locking member may comprise an annular portion which abuts the first coupling members when they are in the first, engaged position.

The locking member may comprise an inclined face which abuts an inclined face of the first coupling members when they are in the first, engaged position.

The second tubular body may further comprise a guide member which guides the movement of the locking member between its first, engaged position and its second, disengaged position.

The guide member may be tubular.

Preferably, the longitudinal axis of the guide member is aligned with the longitudinal axis of the second tubular body.

In one embodiment, the frangible retaining member extends between the second tubular body and the locking member.

A connector assembly according to any of the preceding claims, wherein the first tubular body is an upper tubular body and the second tubular body is a lower tubular body.

The second tubular body may further comprise an end fitting engagement member engageable by the end fitting of the movable subsea structure as it moves downwardly through the second tubular body, the end fitting engagement member being movable between a first position in which it is retainable by a frangible member and a second position in which it displaces the locking member to its second, disengaged position.

The frangible retaining member is preferably configured both to retain the locking member in its first, engaged position and to retain the engagement member in its first position.

The frangible retaining member may comprise a first frangible portion which is configured to retain the engagement member in its first position and a second frangible portion which is configured to retain the locking member in its first, engaged position.

The first frangible portion may be located between the engagement member and the second tubular body and the second frangible portion is located between the engagement member and the locking member.

In one embodiment, the applied force required for the first frangible portion to fail is less than the applied force required for the second frangible portion to fail.

The second tubular body may further comprise a plurality of second coupling members each mounted in a respective recess in the second tubular body and movable between an extended, coupling position in which they are received in their respective recesses and a retracted, uncoupling position in which they are withdrawn inwardly from the one or more recesses, the second coupling members being engaged with and displaceable by movement of the engagement member, whereby the first and second positions of the end fitting engagement member correspond to the extended, coupling position and the second, uncoupling position respectively of the second coupling members.

The second tubular body may further comprise a guide member which guides the movement of the engagement member between its first and second positions.

Preferably, the same guide member guides the movement of the engagement member and the locking member.

Preferably, the guide member is tubular.

Preferably, the longitudinal axis of the guide member is aligned with the longitudinal axes of the first and second tubular bodies.

Preferably, connector assembly comprises a plurality of frangible retaining members.

BRIEF DESCRIPTION OF THE DRAWINGS

By way of example only, a specific embodiment of the present invention will now be described with reference to the accompanying drawings, in which.

DETAILED DESCRIPTION

Figure 1:
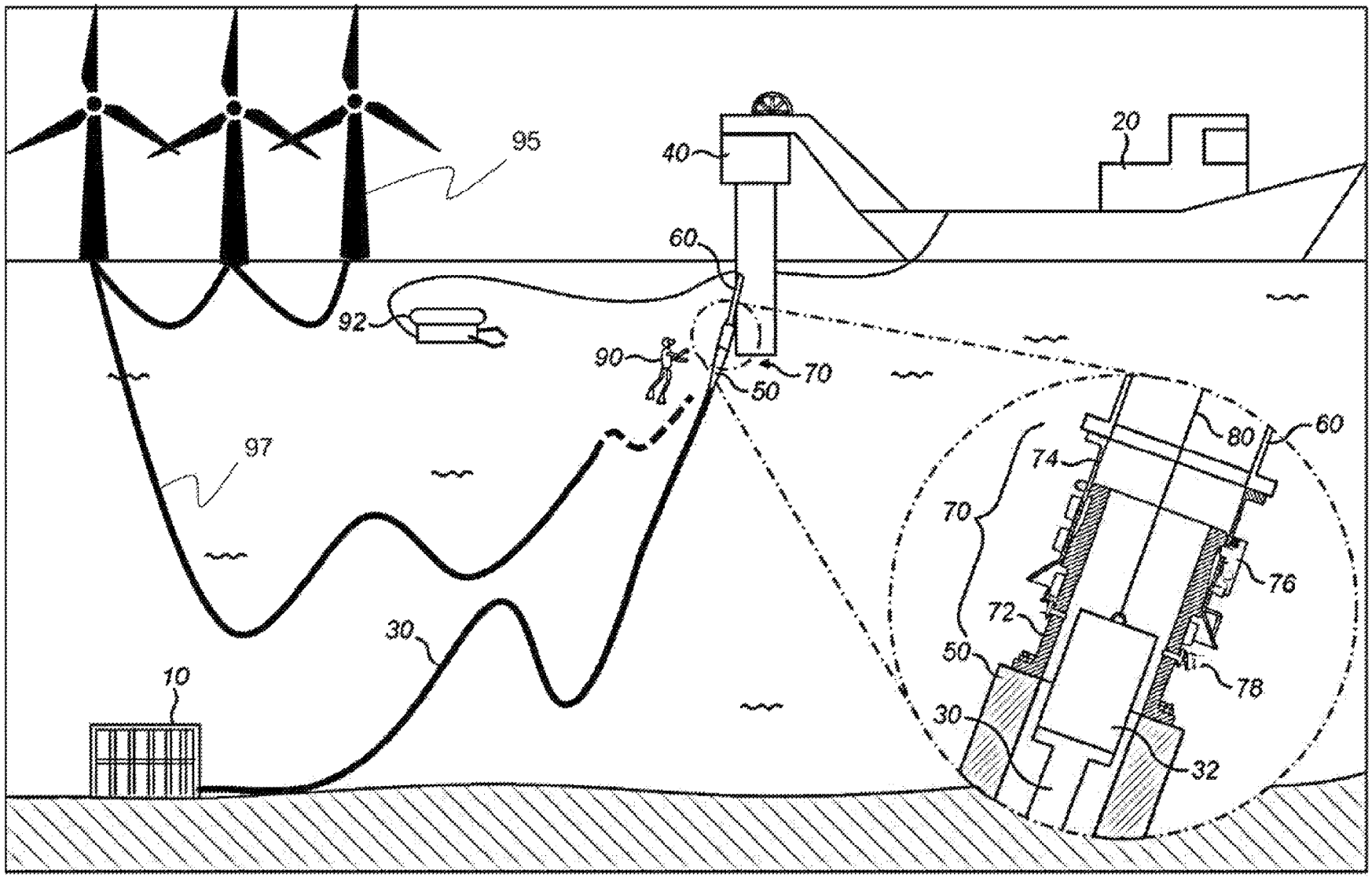
FIG. 1 (Prior Art)
FIG. 1 shows an example of a typical offshore setup for producing hydrocarbons from a subsea well and transferring the fluids to and from a FPSO via a flexible riser, wherein the riser is protected by a bend stiffener at the point of entering an 'I-' or 'J-tube' of the FPSO.

The described example embodiment relates emergency decoupling of a subsea end-fitting used within a subsea connector assembly. However, the invention is not limited to subsea applications and may be used for any other type of couplings.

Certain terminology is used in the following description for convenience only and is not limiting. The words 'right', 'left', 'lower', 'upper', 'front', 'rear', 'upward', 'down', 'downward', 'above', 'below', 'uphole' and 'downhole' designate directions in the drawings to which reference is made and are with respect to the described component when assembled and mounted (e.g. in situ). In particular, the designated directions used in the description are with respect to the equipment installed within the arrangement so as to provide a connection between the FPSO and the subsea well/reservoir. In particular, the terms 'top', 'upper' and 'uphole' refer to the side of the equipment directed towards the surface when in situ, the terms 'bottom', 'lower' and 'downhole' refer to the side of the equipment directed towards the seabed or seafloor when in situ. The words 'inner', 'inwardly' and 'outer', 'outwardly' refer to directions toward and away from, respectively, a designated centreline or a geometric centre of an element being described (e.g. central axis), the particular meaning being readily apparent from the context of the description.

Further, as used herein, the terms 'connected', 'attached', 'coupled', 'mounted' are intended to include direct connections between two members without any other members interposed therebetween, as well as, indirect connections between members in which one or more other members are interposed therebetween. The terminology includes the words specifically mentioned above, derivatives thereof, and words of similar import.

The terms 'fixed structure', 'turret', 'I-tube' and 'J-tube' may be used interchangeably. A 'riser' is understood to mean any string of tubulars or umbilicals suitable to operatively connect the subsea well or any other seafloor equipment with the fixed structure, e.g. a FPSO vessel. The terms 'connector assembly'/'connector' and 'adapter assembly'/'adapter'/'adapter ring' may be used interchangeably.

Further, unless otherwise specified, the use of ordinal adjectives, such as, 'first', 'second', 'third' etc. merely indicate that different instances of like objects are being referred to and are not intended to imply that the objects so described must be in a given sequence, either temporally, spatially, in ranking or in any other manner.

Through the description and claims of this specification, the terms 'comprise' and 'contain', and variations thereof, are interpreted to mean 'including but not limited to', and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality, as well as, singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract or drawings), or to any novel one, or any novel combination, of the steps of any method or process so disclosed.

Figure 2:
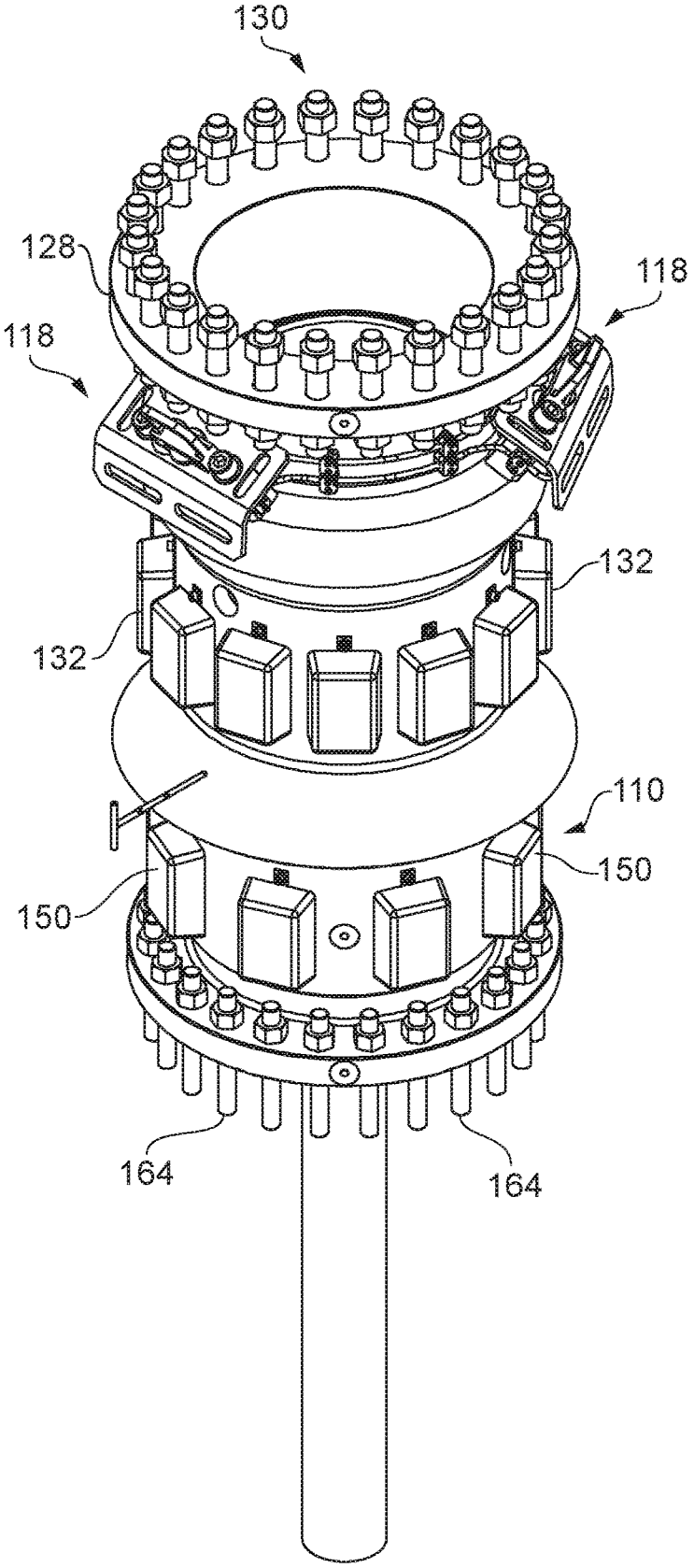
FIG. 2 is a perspective view of an embodiment of connector assembly in accordance with the present invention, shown engaged with a corresponding female coupling element.
Figure 3:
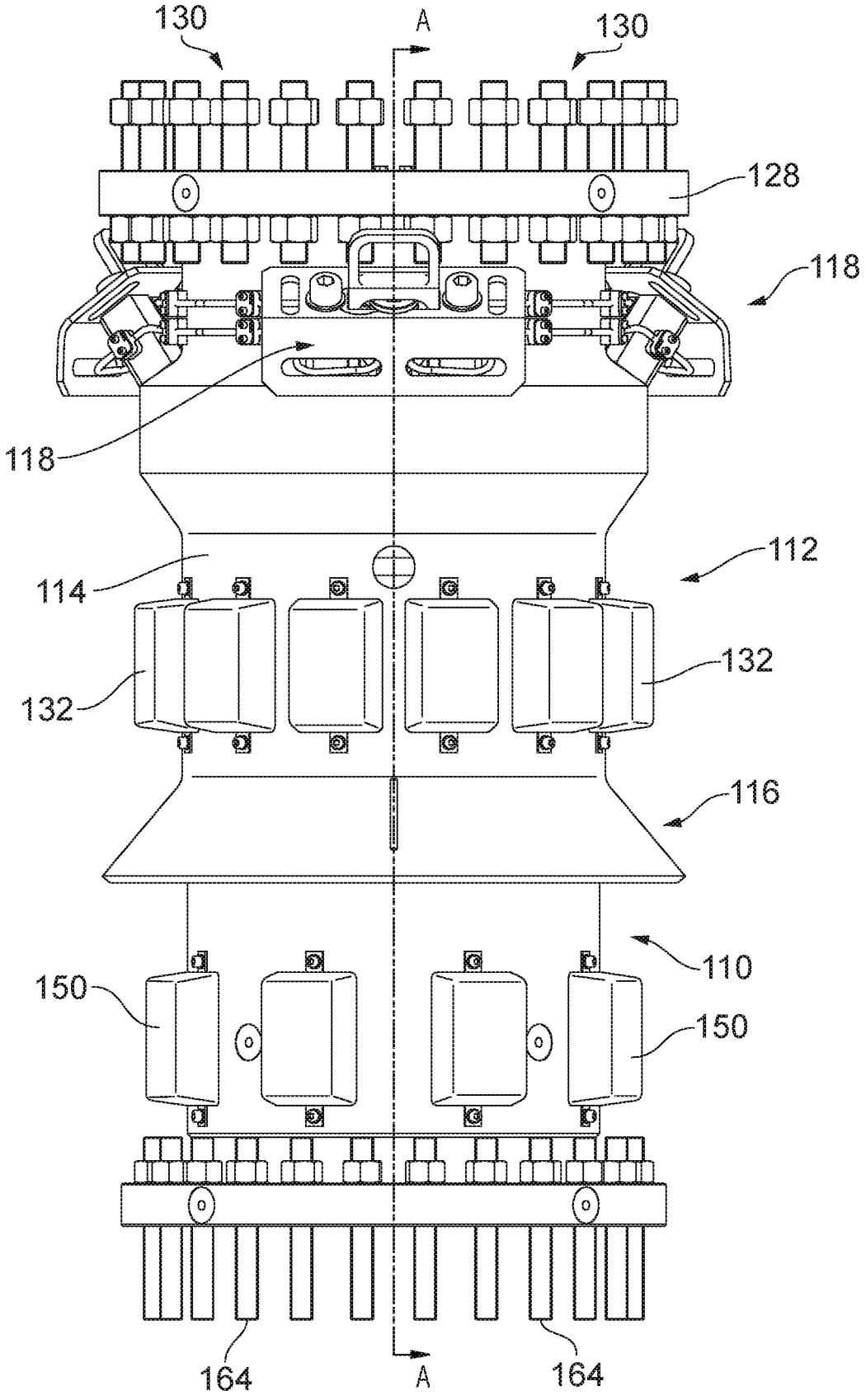
FIG. 3 is a side view of the engaged connector assembly and corresponding female coupling element.
Figure 4:
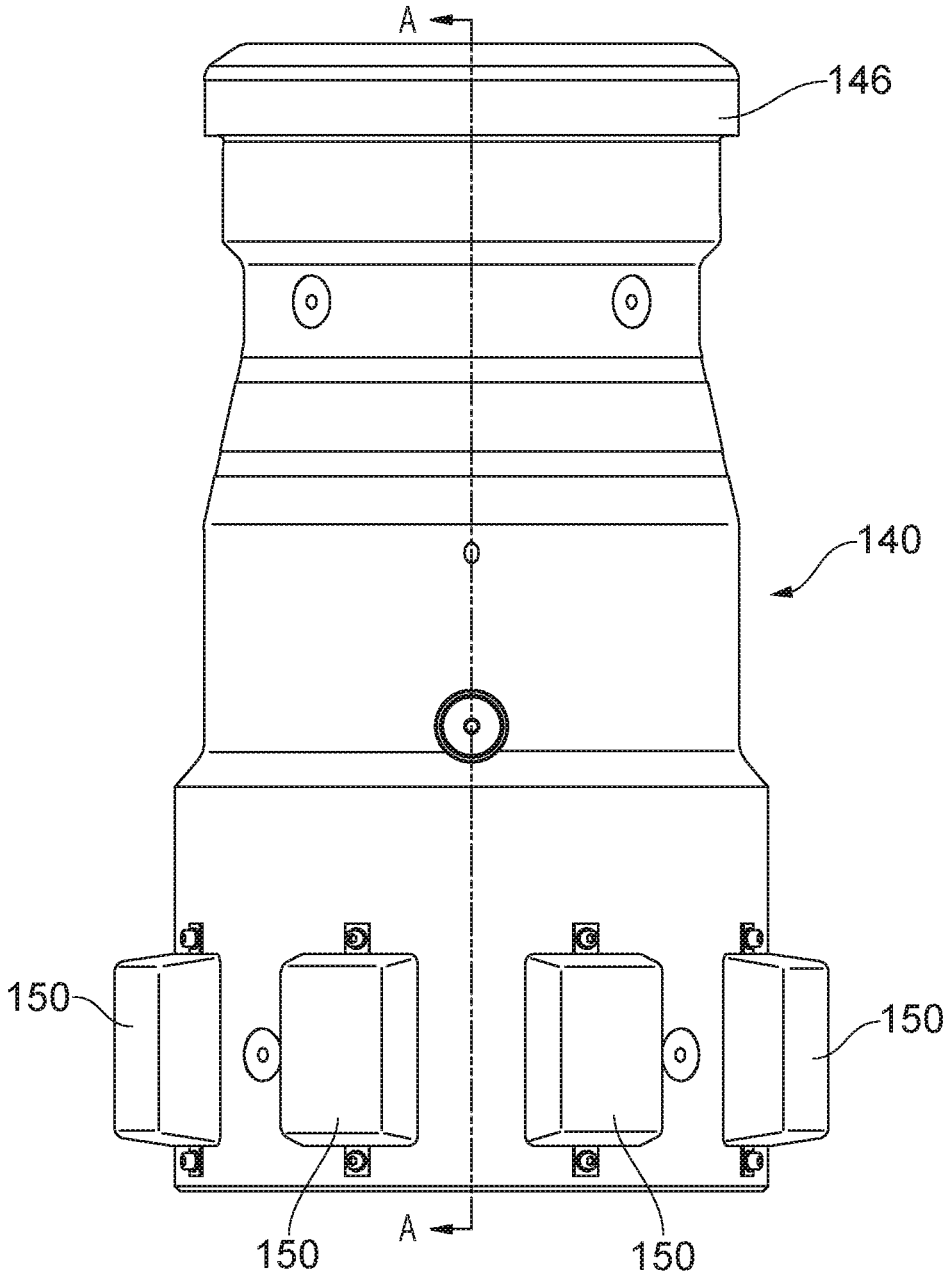
FIG. 4 is a side view of an upper connector body of the connector assembly of FIG. 2.
Figure 6:
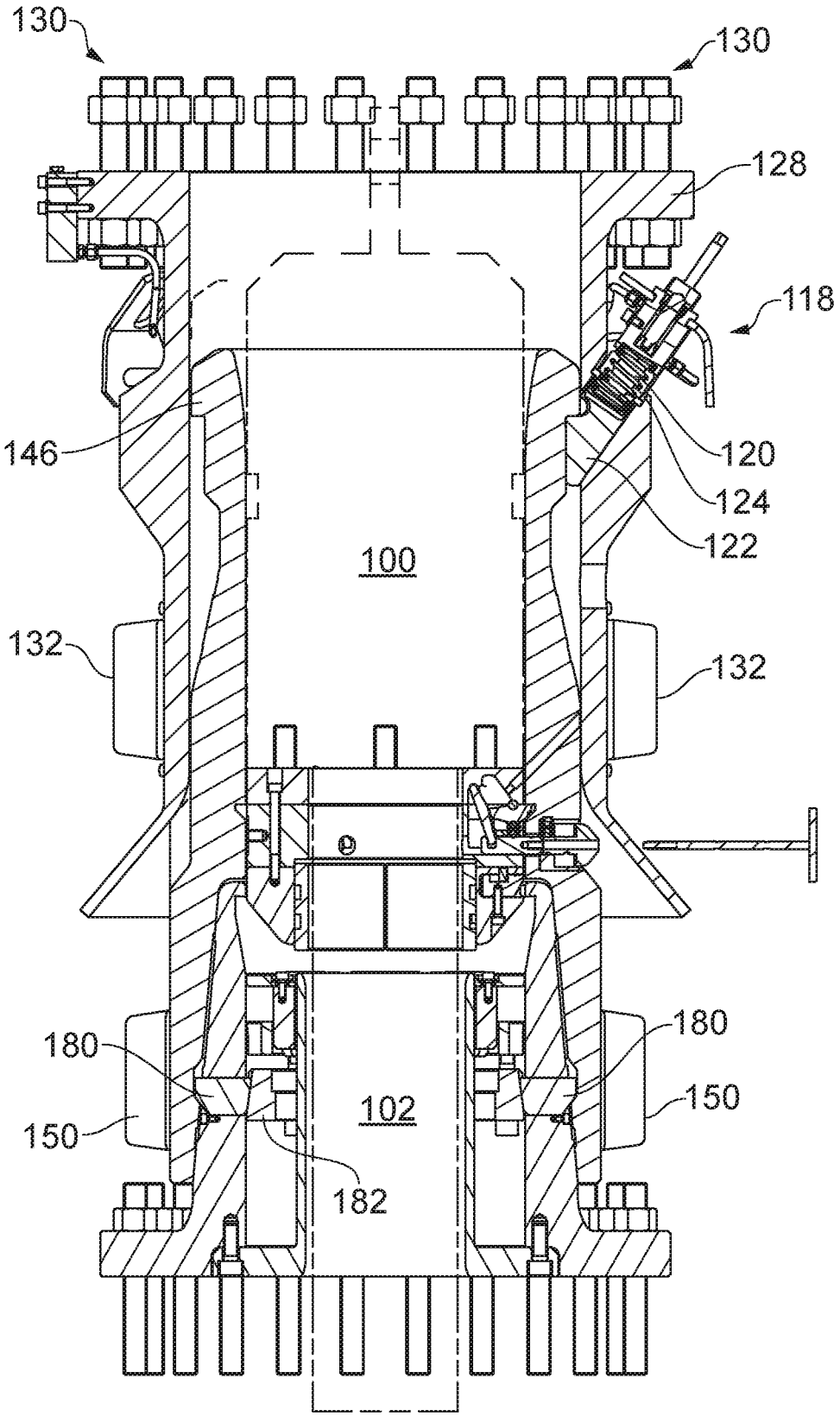
FIG. 6 is a vertical cross-section through the engaged connector assembly and corresponding female coupling element shown in FIGS. 2 and 3, looking in the direction of arrows A-A of FIG. 3.

FIGS. 2, 3 and 6 show a male connector assembly 110 in accordance with the present invention, received within a complementarily-shaped female connector component 112. The female connector component 112 comprises a generally tubular body 114 with a bell mouth 116 at its lower end. Three identical externally mounted spring-loaded latches 118 are mounted towards the upper end of the tubular body 114 and are equally angularly spaced around the periphery of the body. Each latch 118 comprises an elongate plunger 120 having an engagement head 122. The plunger 120 is inclined upwardly with respect to the longitudinal axis of the tubular body 114 and is biased by means of a compression spring 124 towards a position in which the engagement head projects into the interior of the generally tubular body 114 to engage an upper portion of the connector assembly 110 in an emergency, as will be explained.

The upper end of the tubular body 114 is provided with a mounting flange 128 which, in use, is secured to a corresponding mounting flange (not shown) located at a lower end of an I- or J-tube (not shown) by means of a plurality of securing bolts 130 equally angularly spaced around the periphery of the mounting flange 128. The outer face of the tubular body 114 is also provided with twelve identical anode assemblies 132 equally angularly spaced around its periphery.

As best seen in FIGS. 4 to 7, the connector assembly 110 comprises an elongate tubular upper connector body 140 and a lower connector body 144. The upper connector body 140 has a generally frustoconical socket portion 142 formed at its lower end for receipt of the lower tubular connector body 144 which is shaped complementarily with the socket portion 142. As will be explained, the lower connector body 144 is normally retained within the socket portion 142 of the upper connector body 140, but in an emergency the lower connector body 144 can be disconnected from the upper connector body 140 and withdrawn out of the socket portion 142, leaving the upper connector body 114 mounted to the female connector component 112.

Figure 5:
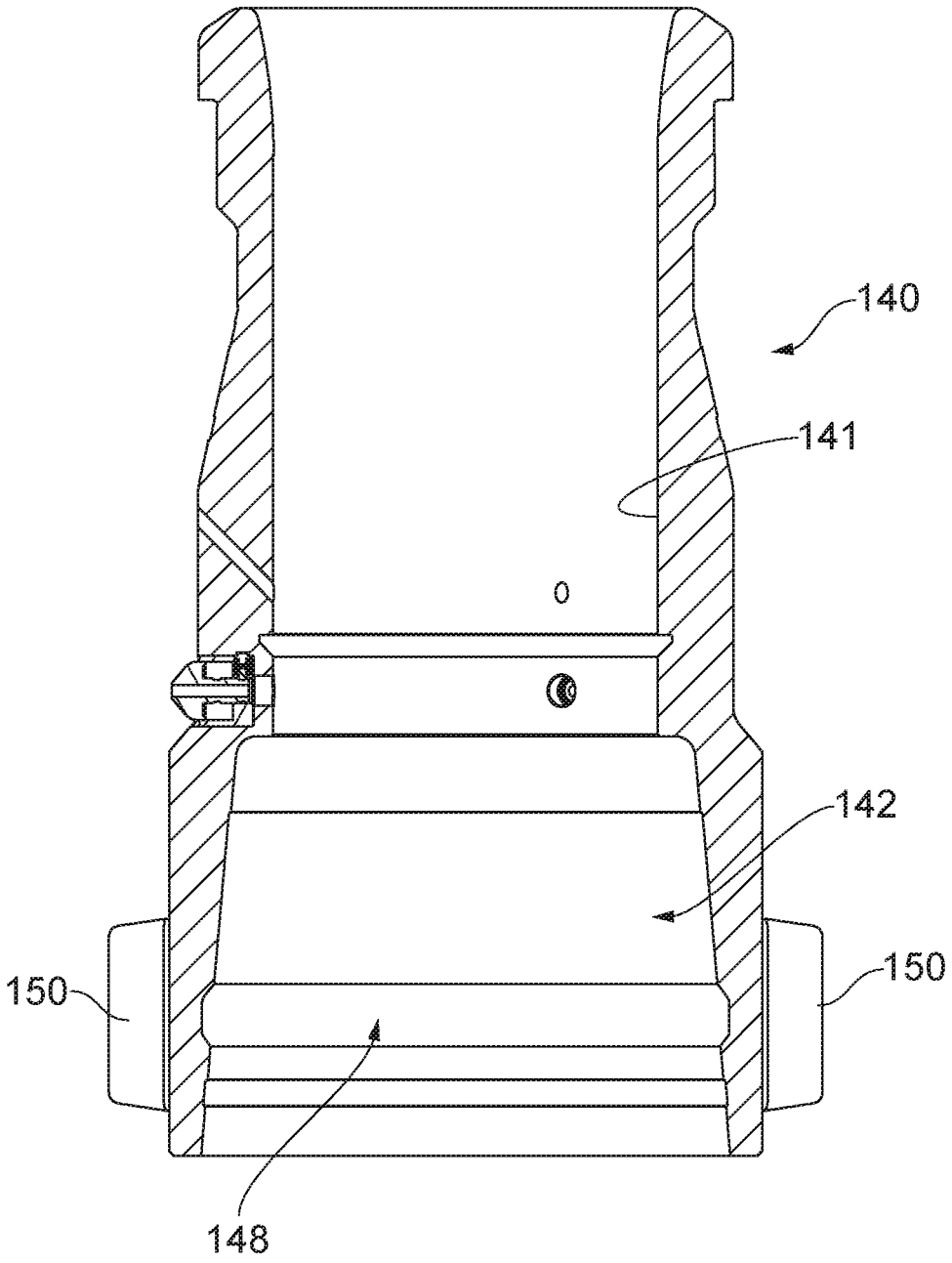
FIG. 5 is a vertical cross-section through the upper connector body of the connector assembly of FIG. 2, looking in the direction of arrows A-A of FIG. 4.

The upper end of the upper connector body 140 is provided with a peripheral lip 146 which is configured to engage with the engagement heads 122 of the latches 118 mounted on the female connector component 112 to retain the upper connector body 140 within the female connector component 112, as shown in FIG. 6. As best seen in FIG. 5, the inner wall of the socket portion 142 is provided with a circumferentially extending recess 148 for receipt of a plurality of coupling members mounted on the lower connector body 144, as will be explained.

Above the socket portion 142, the interior of the upper connector body 140 is formed into a through passage 141 for receipt of an end fitting 100 connected to the upper end of a subsea tubular 102 (FIG. 6). The outer face of the upper connector body 140 is also provided with eight identical anode assemblies 150, identical to the anode assemblies 132, equally angularly spaced around its periphery adjacent to its lower end.

As best seen in FIGS. 7 to 12, the lower connector body 144 comprises a tubular, externally frustoconical body 160 having a radially extending connecting flange 162 at its lower end. In use, the lower connector body 144 is secured to the upper end of a bend stiffener (see FIGS. 13 to 16) by means of twenty-four identical, equally angularly spaced studs 164 and associated identical securing nuts 168. A tubular liner 170 is mounted coaxially within the body 160 and is secured to the body 160 by means of a plurality of identical boats 172 passing through apertures in a radially extending securing flange 174 at the lower end of the liner.

Figure 7:
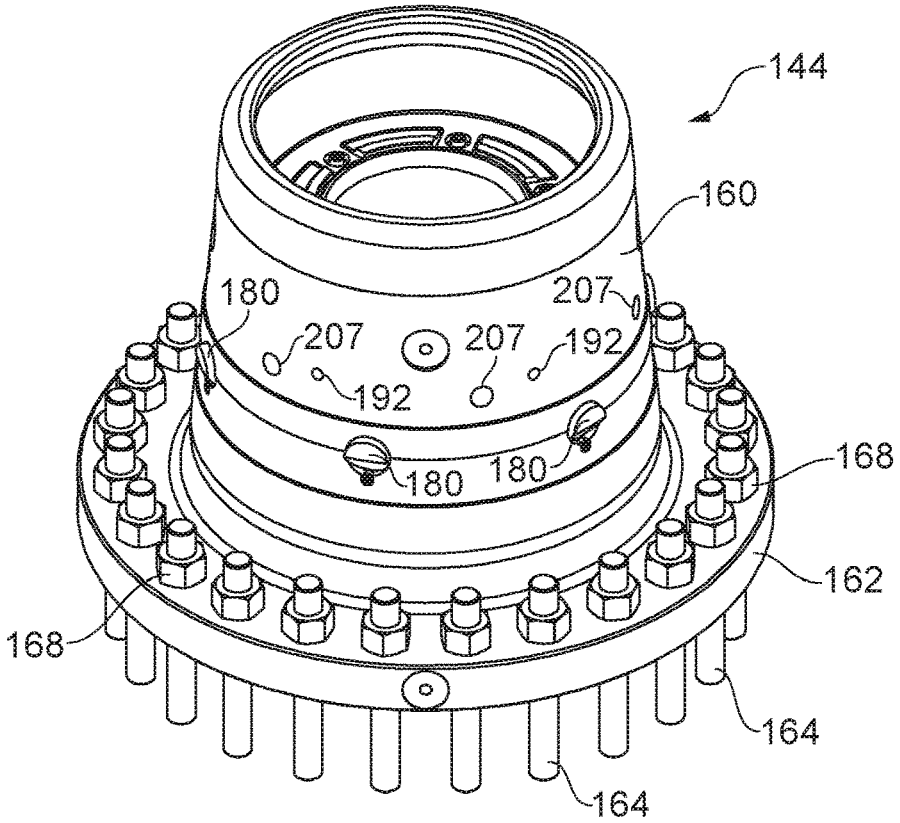
FIG. 7 is a perspective view of a lower component of the connector assembly of FIG. 2.
Figure 8:
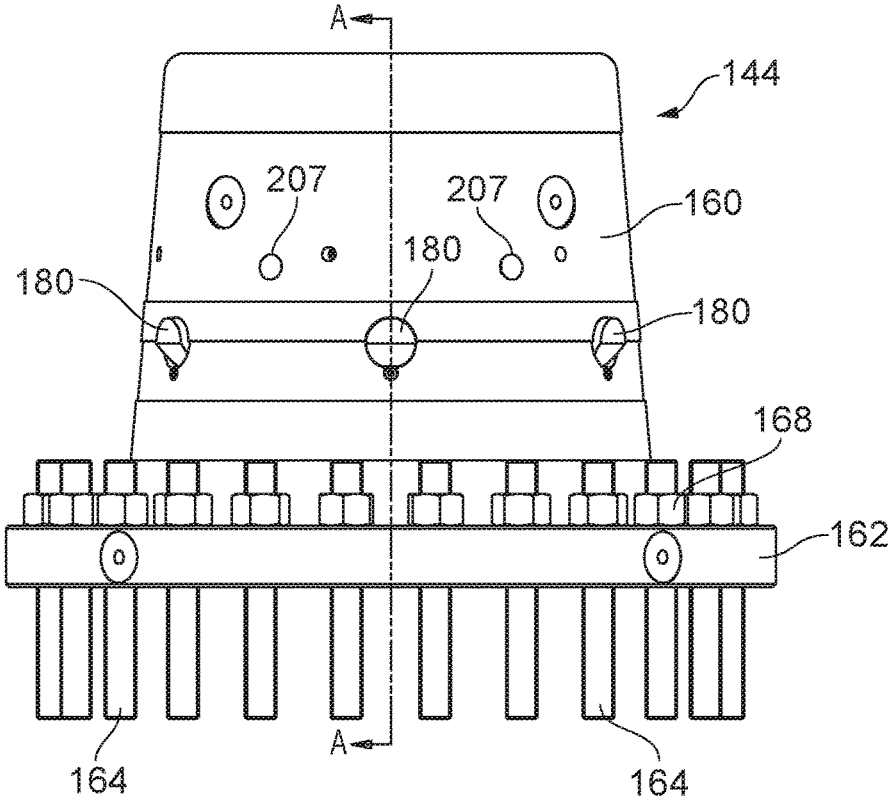
FIG. 8 is a side view of the component of FIG. 6.
Figure 9:
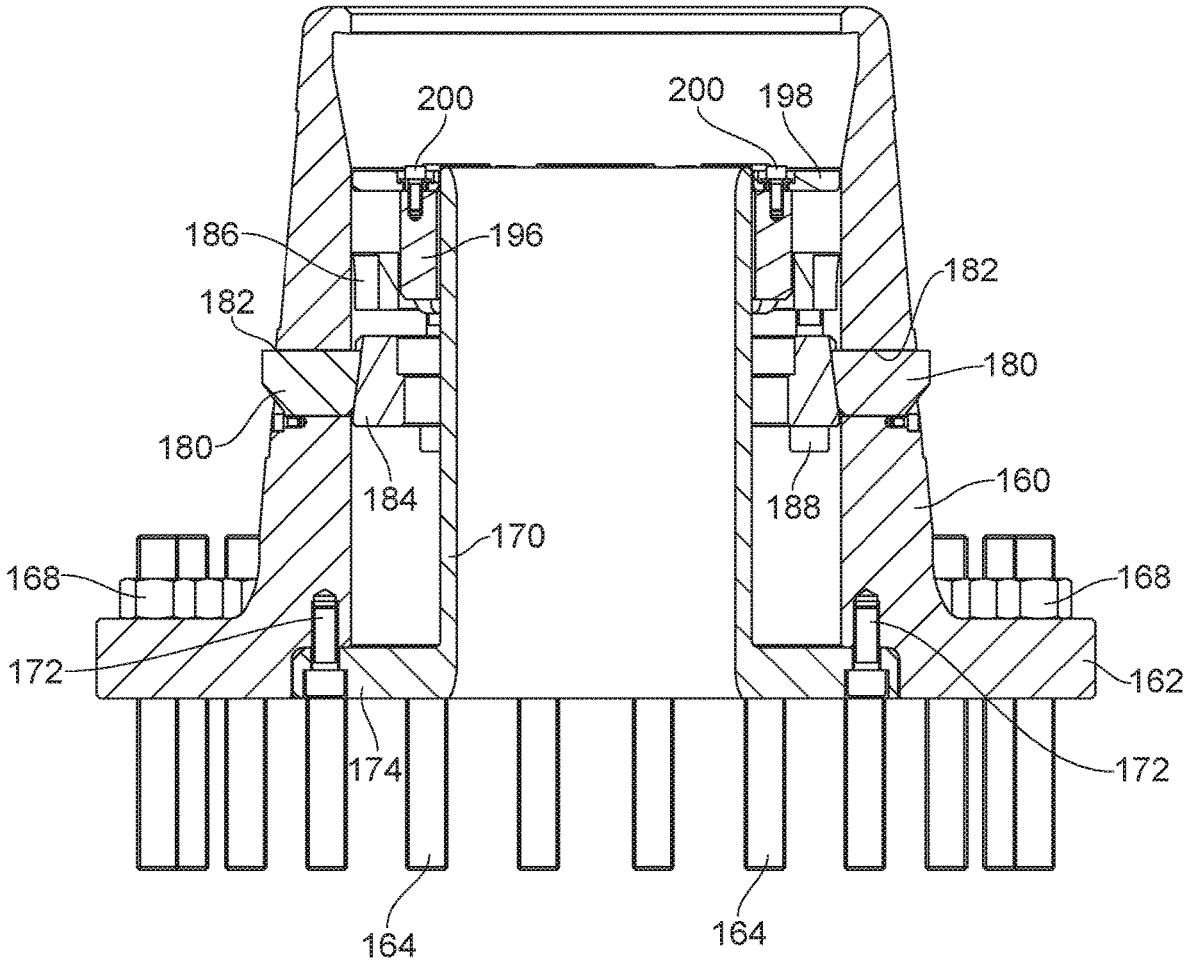
FIG. 9 is a vertical cross-section of the component of FIG. 6, looking in the direction of arrows A-A of FIG. 8.
Figure 10:
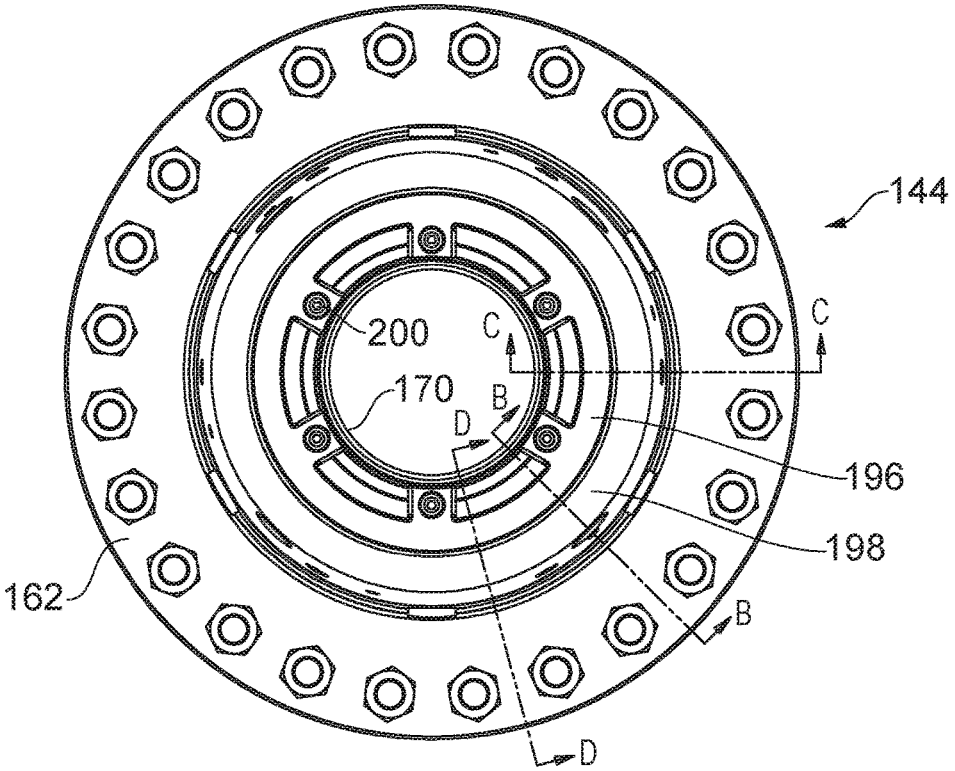
FIG. 10 is a plan view of the component of FIG. 6.

As best seen in FIGS. 7 to 9, a set of six first identical coupling members in the form of clamping pins 180 are slidably mounted in radially extending recesses 182 extending through the wall of the lower connector body 144. The clamping pins 180 are displaceable radially inwardly and outwardly but in normal use the outer ends project beyond the outer surface of the lower connector body 144 and are received in the circumferentially extending recess 148 in the inner wall of the socket portion 142 of the upper connector body 140, as shown in FIG. 6. In normal use, the clamping pins 180 are prevented from being displaced radially inwardly by abutment of the inner faces with the outer face of a clamping ring 184 mounted within the lower connector body 144.

Figure 11:
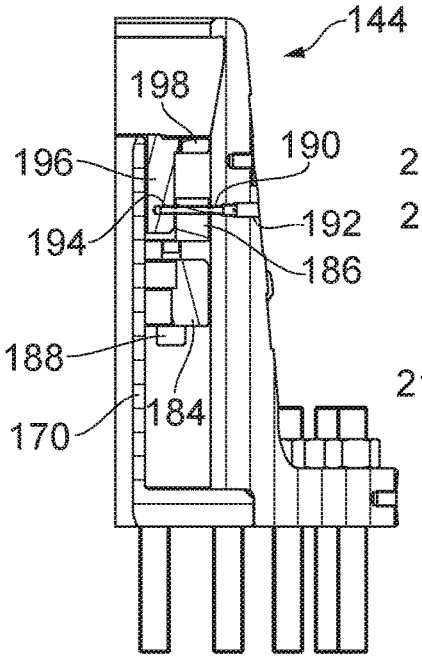
FIG. 11 is a cross-section through the component of FIG. 6, looking in the direction of arrows B-B of FIG. 10.

The clamping ring 184 is in turn connected to a locking ring 186 by means of six bolts 188. In normal use, the locking ring 186 is held in a fixed axial position within the lower connector body 144 by means of six identical dual fuse shear pins 190 equally angularly spaced around the periphery of the lower connector body 144 (see FIG. 11). Each of the fuse pins 190 is received in a respective bore 192 extending radially through the wall of the lower connector body 144 and through an aligned bore in the locking ring 186. As best seen in FIG. 11, the inner end of each of the dual fuse shear pins 190 is threadedly received in an aperture 194 in a retraction ring 196 located radially inwardly of the locking ring 186 and is slidably mounted with respect to both the outer face of the tubular liner 170 and the inner face of the locking ring 186. An annular cover plate 198 is secured to the upper end of the retraction ring 196 by means of six identical retaining bolts 200 equally angularly spaced around the cover plate 198.

Figure 12:
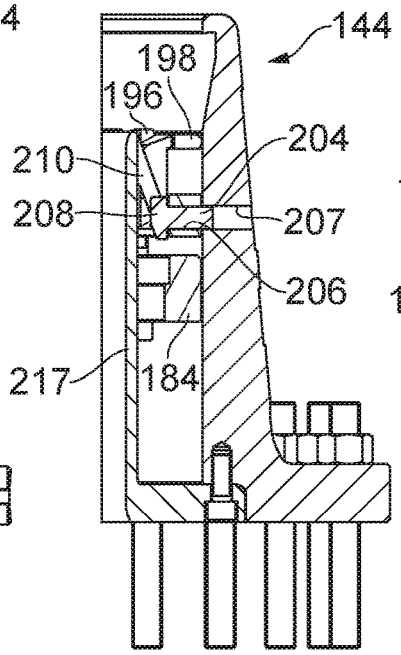
FIG. 12 is a cross-section through the component of FIG. 6, looking in the direction of arrows C-C of FIG. 10.
Figure 13:
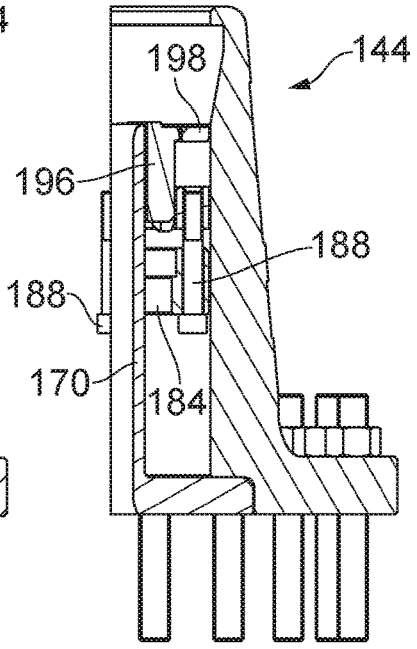
FIG. 13 is a cross-section through the component of FIG. 6, looking in the direction of arrows D-D of FIG. 10.

As best seen in FIGS. 7, 8 and 12, a second set of six identical radially displaceable locking pins 204 are slidably mounted in respective apertures 206 extending radially through the locking ring 186. As will be explained, radial displacement of the locking pins 204 causes their outer ends to be engage with or disengaged from complementarily-shaped apertures 207 extending radially through the wall of the lower connector body 144. Each of the locking pins 204 has an enlarged head 208 at its radially inner end which is received in a respective cavity 210 within the retraction ring 196. The cavities 210 are shaped so that displacement of the retraction ring 196 in the longitudinal direction causes the locking pins to be displaced radially inwardly and outwardly. In particular, downward and upward displacement of the retraction ring 196 causes the locking pins 204 to be displaced inwardly and outwardly respectively.

As explained previously, in normal use the dual fuse shear pins 190 extend through the locking ring 186 and into the threaded apertures 194 in the outer face of the retraction ring 196. As a result, during normal operation the locking ring 186 and the retraction ring 196 are retained in the uppermost positions, which causes the outer ends of the locking pins 204 to be received and retained in the apertures 207 in the wall of the lower connector body 144. However, as will be explained, when a downward force is applied to the retraction ring 196 which is sufficient to shear the inner end of the shear pins 190, the retraction ring 196 moves downwardly which results in radially of the locking pins 204 inward displacement and disengagement of the locking pins 204 from the apertures 207 in the wall of the lower connector body 144.

In use, the male connector assembly 110 is assembled by inserting the frustoconical body 160 of the lower connector body 144 into the socket 142 at the lower end of the upper connector body 140, without the shear pins in place, which allows the first and second sets of clamping pins 180, 204 to be displaced radially inwardly which in turn allows the frustoconical body 160 to be inserted. The second clamping pins 204 are then aligned with the apertures 207 in the wall of the lower connector body 144 and by use of a suitable tool the clamping ring 184, locking ring 186 and retraction ring 196 displaced into the uppermost positions. This causes the first locking pins 180 to be displaced radially outwardly and into the circumferentially extending recess 148 on the inner wall of the socket 142 and causes the second locking pins 204 to be displaced radially outwardly into the sockets 207. The shear pins 190 are then inserted into the apertures 192, through the corresponding apertures in the locking ring 186 and into the threaded recess 194 in the outer face of the retraction ring 196.

As a result, the lower connector body 144 is secured to the upper connector body 140 by the first locking pins 180 and the locking pins 180 are held in the engaged position by abutment with the outer face of the clamping ring 184, the clamping ring 184 being held in position ultimately by the shear pins 190.

The lower end of the lower connector body 144 is then secured to the upper end of a bend stiffener 104 by means of the studs 164 extending downwardly from the peripheral connecting flange 162 at the base of the lower connector body 144 and the associated nuts 168, as illustrated in FIGS. 14 to 17. A subsea tubular 102 is fed through the assembled male connector assembly 110 beyond its upper end, and an end fitting 100 can then be fitted to the upper end of the subsea tubular 102.

The assembled male connector assembly 110 is then fed into the lower end of the female connector component 112. As the peripheral lip 146 at the upper end of the upper connector body 140 meets the three spring-loaded latches 118, the engagement heads 122 displaced upwardly and radially outwardly against the restoring force of the springs 124 to allow the peripheral lip 146 to pass upwardly, after which the engagement heads 122 of the latches 118 spring back. Any subsequent downward movement of the upper connector body 144 causes the lip 146 to engage with the latches 118, thereby preventing any subsequent inadvertent downward movement of the lip 146 past the latches 118.

The end fitting 100 is pulled further through the assembled male connector assembly 110 to be received in, and retained by, a hang-off fitting (which does not form part of this invention), the lower portion of which is illustrated at 220 in FIGS. 14 to 17.

The emergency disconnection sequence of the connector assembly 110 is illustrated in FIGS. 14 to 17.

Figure 14:
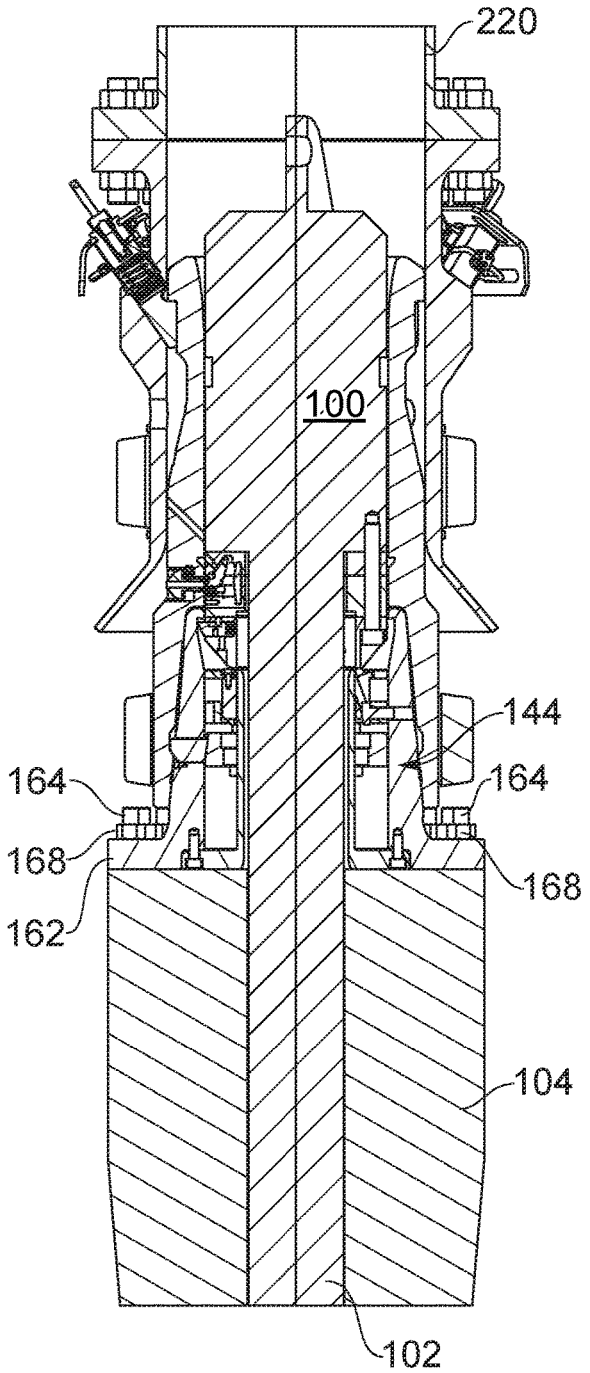
FIGS. 14 to 17 are vertical cross-sections through the connector assembly and corresponding female coupling element of FIG. 2, showing various stages of the emergency disengagement process.

(i) FIG. 14

In the event that the end fitting 100 becomes disconnected from the hang-off fitting, for example as a result of a sustained excessive load on the subsea tubular 102, the end fitting 100 and the subsea tubular 102 falls downwardly through the male connector assembly 110. If the upper peripheral lip 146 of the male connector assembly 110 is not already engaged with the latches 118 on the female connector component 112, the downward movement of the end fitting 100 results in such engagement, thereby preventing further downward movement of the upper connector body 40 with respect to the female connector component 112.

Figure 15:
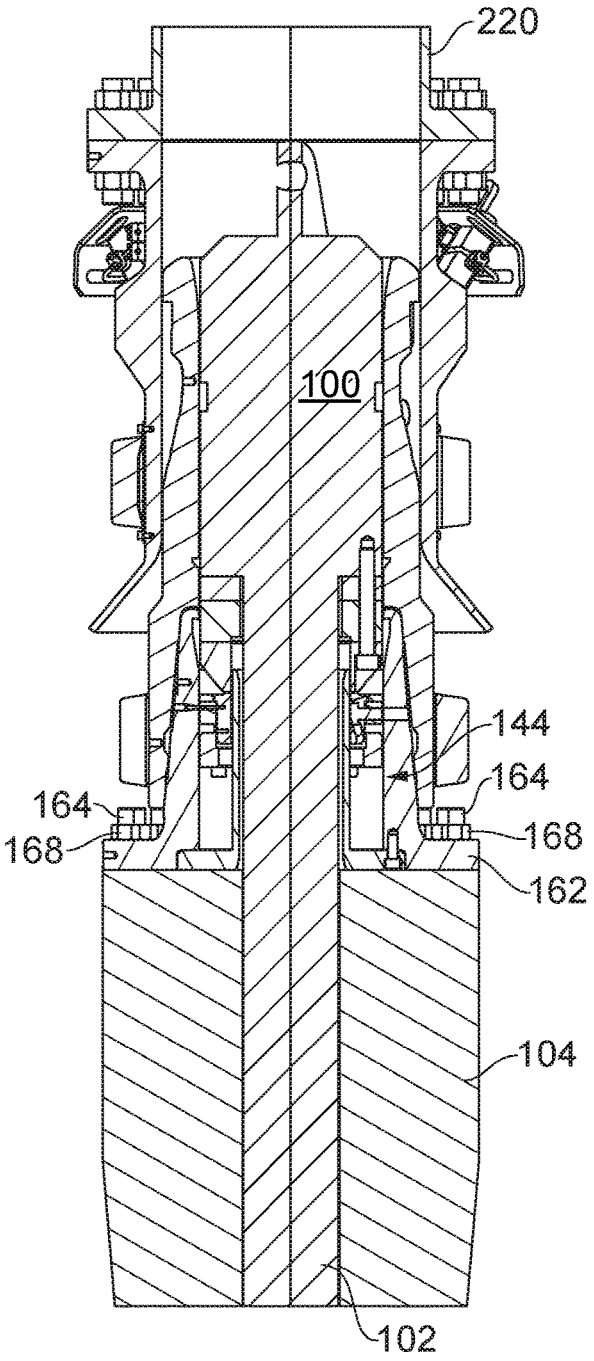

(ii) FIG. 15

Further downward movement of the end fitting 100 causes its lower end to engage with the cover plate 198 within the lower connector body 144, which consequently exerts a downward force on the retraction ring 196 and the locking ring 186 which are secured together by means of the shear pins 190. If that downward force exceeds the capacity of the radially outer end of the fuse pins 190, the retraction ring 196 becomes detached from the locking ring 186. This results in downward movement of the retraction ring 196 which in turn retracts the locking pins 204 radially inwardly, out of engagement with their associated apertures 207 in the frustoconical housing 160. However, at this stage the shear pins 190 still hold the locking ring 186 in position which also retains the clamping ring 184 in position and which in turn keeps the first locking pins 180 in engagement with the circumferentially extending recess 148 on the inner wall of the socket 142.

Figure 16:
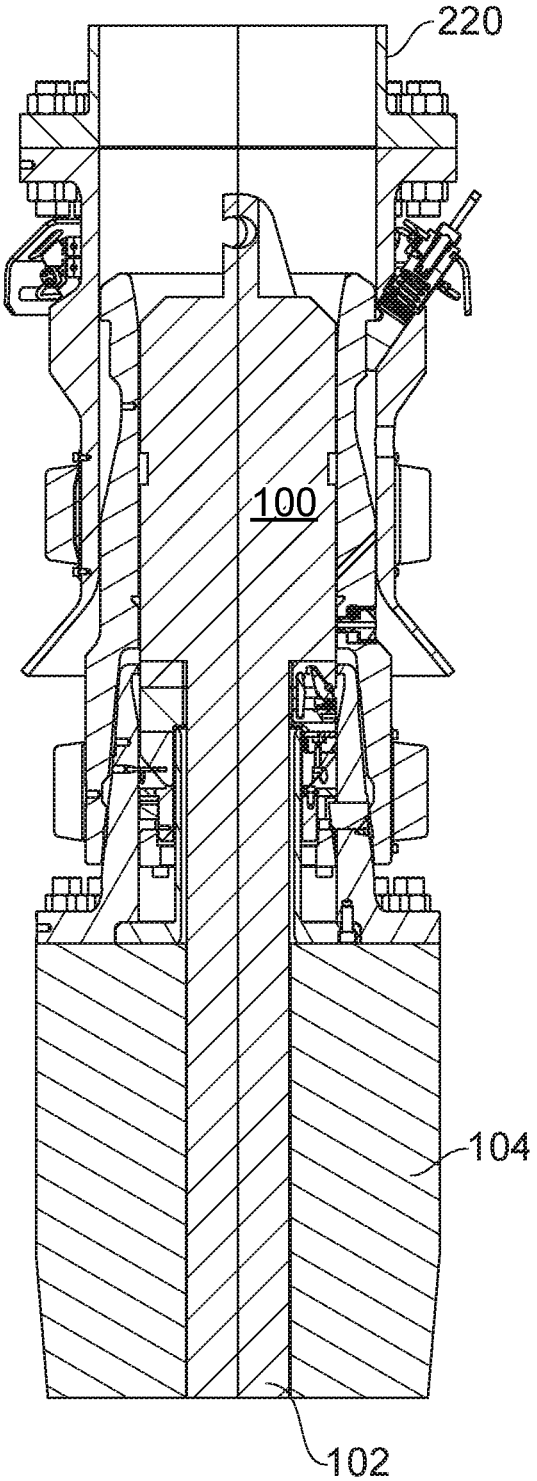

(iii) FIG. 16

If the continued downward force on the subsea tubular 102 exceeds the capacity of the inner end of the fuse pins 190, which may be designed to fail at the same force, a greater force or a smaller force than that required for the outer end, the locking ring 186 becomes detached from the frustoconical housing 160. The clamping ring 184 is therefore no longer retained in its normal position and subsequent downward movement of the end fitting 100 causes the clamping ring to move out of abutment with the inner ends of the first locking pins 180, allowing the locking pins 182 disengage from the circumferentially extending recess 148 on the inner wall of the socket 142.

Figure 17:
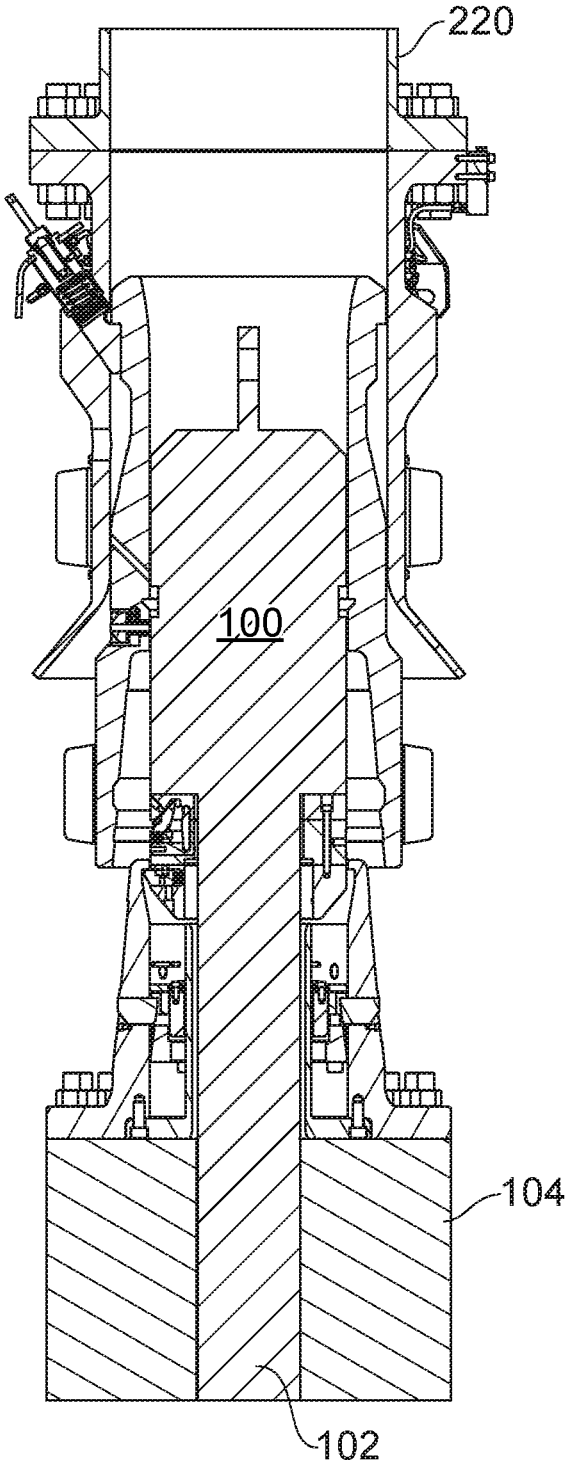

(iv) FIG. 17

At that point, the lower connector body 144 is no longer secured to the upper connector body 140 and the end fitting 100 and the subsea tubular 102 can continue to fall downwardly with the lower connector body 144 and the bend stiffener 104 which is connected to it.

Consequently, in the event of an unplanned cable loading exceeding a specified design loading, the lower male connector body 144 is allowed to detach from the upper connector body 140 in a staged manner, depending on the capacity of the fuse pins 190.

The invention is not restricted to the details of the foregoing embodiment.

The invention claimed is:

1. A connector assembly for emergency decoupling of an end fitting of a movable subsea structure from a tubular fixed subsea structure, comprising:

a first tubular body comprising a first end configured for receipt into, and releasable retention in, the fixed tubular subsea structure, a second end formed into a receiving socket portion and one or more recesses in an inner wall of the socket portion;

a second tubular body having a first end configured for receipt into the socket portion of the first tubular body and a second end configured for connection to one end of the movable subsea structure;

the connector assembly further comprising:

a plurality of first coupling members mounted in the second tubular body and movable between an extended position in which they are received in the one or more recesses in the inner wall of the socket portion and a retracted position in which they are withdrawn from the one or more recesses;

a locking member mounted in the second tubular body and movable between a first, engaged position in which it retains the first coupling members in their extended position and a second, disengaged position in which it allows the first coupling members to move towards their retracted position; and a frangible retaining member configured to retain the locking member in the first, engaged position.

2. A connector assembly according to claim 1, wherein each first coupling member is mounted in an aperture passing through a wall of the second tubular body and extends beyond an outer surface of the second tubular body when in their extended position.

3. A connector assembly according to claim 1, wherein the inner wall of the socket portion of the first tubular body comprises an annular recess in which the first coupling members are received when in their extended position.

4. A connector assembly according to claim 1, wherein the locking member comprises an annular portion which abuts the first coupling members when they are in the first, engaged position.

5. A connector assembly according to claim 4, wherein the locking member comprises an inclined face which abuts an inclined face of the first coupling members when they are in the first, engaged position.

6. A connector assembly according to claim 1, wherein the second tubular body further comprises a guide member which guides the movement of the locking member between its first, engaged position and its second, disengaged position.

7. A connector assembly according to claim 6, wherein the guide member is tubular.

8. A connector assembly according to claim 7, wherein the longitudinal axis of the guide member is aligned with the longitudinal axis of the second tubular body.

9. A connector assembly according to claim 1, wherein the frangible retaining member extends between the second tubular body and the locking member.

10. A connector assembly according to claim 1, wherein the first tubular body is an upper tubular body and the second tubular body is a lower tubular body.

11. A connector assembly according to claim 1, wherein the second tubular body further comprises an end fitting engagement member engageable by the end fitting of the movable subsea structure as it moves downwardly through the second tubular body, the end fitting engagement member being movable between a first position in which it is retainable by a frangible member and a second position in which it displaces the locking member to its second, disengaged position.

12. A connector assembly according to claim 11, wherein the frangible retaining member is configured both to retain the locking member in its first, engaged position and to retain the engagement member in its first position.

13. A connector assembly according to claim 12, wherein the frangible retaining member comprises a first frangible portion which is configured to retain the engagement member in its first position and a second frangible portion which is configured to retain the locking member in its first, engaged position.

14. A connector assembly according to claim 13, wherein the first frangible portion is located between the engagement member and the second tubular body and the second frangible portion is located between the engagement member and the locking member.

15. A connector assembly according to claim 13, wherein the applied force required for the first frangible portion to fail is less than the applied force required for the second frangible portion to fail.

16. A connector assembly according to claim 11, wherein the second tubular body further comprises a plurality of second coupling members each mounted in a respective recess in the second tubular body and movable between an extended, coupling position in which they are received in their respective recesses and a retracted, uncoupling position in which they are withdrawn inwardly from the one or more recesses, the second coupling members being engaged with and displaceable by movement of the engagement member, whereby the first and second positions of the end fitting engagement member correspond to the extended, coupling position and the second, uncoupling position respectively of the second coupling members.

17. A connector assembly according to claim 11, wherein the second tubular body further comprises a guide member which guides the movement of the engagement member between its first and second positions.

18. A connector assembly according to claim 17, wherein the same guide member guides the movement of the engagement member and the locking member.

19. A connector assembly according to claim 18, wherein the guide member is tubular.

20. A connector assembly according to claim 19, wherein the longitudinal axis of the guide member is aligned with the longitudinal axes of the first and second tubular bodies.

21. The connector assembly according to claim 1, comprising a plurality of frangible retaining members.

* * * * *